US011207914B2

(12) United States Patent
Kjellander et al.

(10) Patent No.: US 11,207,914 B2
(45) Date of Patent: Dec. 28, 2021

(54) DECORATIVE PANEL

(71) Applicant: TRESPA INTERNATIONAL B.V. [NL/NL], Weert (NL)

(72) Inventors: Birgitta Katarina Charlotte Kjellander, Weert (NL); Henricus Hubertus Maria Kömhoff, Weert (NL)

(73) Assignee: TRESPA INTERNATIONAL B.V., Weert (NL)

( * ) Notice: Subject to any disclaimer, the term of this patent is extended or adjusted under 35 U.S.C. 154(b) by 775 days.

(21) Appl. No.: 16/077,945

(22) PCT Filed: Feb. 17, 2017

(86) PCT No.: PCT/NL2017/050100

§ 371 (c)(1),
(2) Date: Aug. 14, 2018

(87) PCT Pub. No.: WO2017/142412

PCT Pub. Date: Aug. 24, 2017

(65) Prior Publication Data

US 2021/0086551 A1 Mar. 25, 2021

(30) Foreign Application Priority Data

Feb. 18, 2016 (NL) ..... 2016282

(51) Int. Cl.
*B44C 5/04* (2006.01)
*F21V 33/00* (2006.01)
(Continued)

(52) U.S. Cl.
CPC ..... *B44C 5/0469* (2013.01); *F21V 33/006* (2013.01); *F21Y 2105/10* (2016.08); *F21Y 2115/15* (2016.08)

(58) Field of Classification Search
CPC ..... B44C 5/0469; F21V 33/006
(Continued)

(56) References Cited

U.S. PATENT DOCUMENTS 5,085,940 A * 2/1992 Dion ..... C08L 63/10 428/413
5,175,030 A * 12/1992 Lu ..... B32B 38/06 428/30
(Continued)

FOREIGN PATENT DOCUMENTS

DE 19811076 A1 9/1999
DE 20314228 U1 11/2003
(Continued)

OTHER PUBLICATIONS

International Search Report for International Application No. PCT/NL2017/050100 dated Jun. 19, 2017.

*Primary Examiner* — Bryon T Gyllstrom
(74) *Attorney, Agent, or Firm* — Suiter Swantz pc llo

(57) ABSTRACT

The present invention relates to a decorative panel, comprising a core layer provided with a decor layer, the décor layer comprising a substrate layer provided with at least one coating, wherein within the decorative panel at least one light source is located. The present invention furthermore relates to the use of such a decorative panel in furniture, in exterior walls and facades and in interior decoration.

28 Claims, 4 Drawing Sheets

(51) Int. Cl.
*F21Y 105/10* (2016.01)
*F21Y 115/15* (2016.01)

(58) Field of Classification Search
USPC ..... 52/578
See application file for complete search history.

(56) References Cited

U.S. PATENT DOCUMENTS

| | | | | |
|---|---|---|---|---|
| 5,598,652 | A * | 2/1997 | Nurre | G09F 13/00 362/412 |
| 7,112,372 | B2 * | 9/2006 | Blair | B44C 5/0469 428/626 |
| 9,925,915 | B2 * | 3/2018 | Bauerle | B32B 17/10541 |
| 10,596,787 | B2 * | 3/2020 | Greenall | B32B 17/10651 |
| 10,647,092 | B2 * | 5/2020 | Bauerle | B60Q 3/80 |
| 10,688,924 | B2 * | 6/2020 | Bauerle | F21V 5/045 |
| 2005/0238857 | A1 * | 10/2005 | Day | B32B 17/10174 428/209 |
| 2012/0176776 | A1 * | 7/2012 | Van Herpen | F21V 31/00 362/147 |
| 2015/0191042 | A1 * | 7/2015 | Ma | B44C 5/0469 428/141 |

FOREIGN PATENT DOCUMENTS

| | | | |
|---|---|---|---|
| EP | 2 305 457 | A1 | 4/2011 |
| EP | 2 463 115 | A1 | 6/2012 |
| WO | 2007/079512 | A1 | 7/2007 |

* cited by examiner

DECORATIVE PANEL

TECHNICAL FIELD AND BACKGROUND

The present invention relates to a decorative panel, comprising a core layer provided with a decor layer wherein the décor layer comprises a substrate layer provided with at least one coating. Furthermore, the present invention relates to the use of such a panel.

Decorative high-pressure compact laminates manufactured by the present applicant are known for outdoor applications. Such laminates consist of layers of wood-based fibres (paper and/or wood) impregnated with thermosetting resins and surface layer(s) on one or both sides, having decorative colours or designs. A transparent topcoat is added to the surface layer(s) and cured to enhance weather and light protecting properties. These components are bonded together with simultaneous application of heat and high specific pressure to obtain a homogeneous non-porous material with increased density and integral decorative surface. These panels have been disclosed in, inter alia, U.S. Pat. Nos. 4,801,495, 4,789,604, US Patent application 2013/0078437.

Such panels are non-intelligent panels. This means that the function of these panels is for construction and for aesthetic purposes only. But, interactive panels are known in the art, for example panels provided with light sources.

German Offenlegungsschrift DE 10 2012 019 421 relates to an illuminated facade panel with an integrated light source, particularly in the form of a row-shaped light emitting diode array. Multiple elongated light deflection profiles in parallel arrangement to each other form the common luminous panel main surface of the facade panel and are arranged spaced from each other, such that the facade panel is transparent from a panel rear side. The light source is arranged laterally on the edge of the panel main surface and is provided with a deflecting optics, such that the light of the light source is thrown entirely on the light deflection profiles at an acute angle to the panel main surface, from which the light is completely radiated to panel front side.

US patent application publication No. 2012/120650 relates to a lighting device comprising: (a) a main assembly including: (i) at least one optic holder, wherein each one of the at least one optic holder includes: an holder body, having an holder upper surface and an holder bottom surface, wherein the bottom surface includes at least one holder opening; and at least one holder space wall disposed between the holder upper surface and the holder bottom surface, wherein the holder space wall contains an holder space.

US patent application publication No. 2011/261288 relates to a resin-type light guide plate composition, a backlight unit including the light guide plate formed using the composition, and a liquid crystal display including the backlight unit. This publication provides a resin-type light guide plate composition, which can fabricate a light guide plate useful for a module-type backlight unit exhibiting excellent adhesion to a base film and enabling local dimming while having a low shrinkage rate, by a simple curing process and can form a thick film, a backlight unit including the light guide plate formed using the composition, and a liquid crystal display including the backlight unit.

German Offenlegungsschrift DE 198 11 076 relates to an illuminated laminar panel hot-pressed from resin prepregs and to a method for manufacturing such a panel. According to such a method a number of resin-impregnated fibrous web layers, of which at least several paper layers, are prepared and placed upon each other and at the top a cover layer is placed for the purpose of producing a transparent overlay layer and that construction is pressed at an elevated temperature. During the stacking of the fiber web layers in a flat arrangement, a number of light emitting diode is inserted and connected to a connector arrangement in the same plane. Between the transparent overlay layer and the light emitting diode a phenol resin impregnated paper layer or a urea impregnated resin paper layer is positioned.

BRIEF SUMMARY

An object of the present invention is to provide a decorative panel that has an interactive function.

Another object of the present invention is to provide a decorative panel that is provided with a light source where the light source is seamlessly integrated into the panel and cannot be seen from the outside when the light source is not activated.

Another object of the present invention is to provide a decorative panel that is provided with a light source wherein the light source cannot be easily removed from the panel.

Another object of the present invention is to provide a decorative panel that is provided with a light source wherein the mechanical properties of the decorative panel are maintained over a long period of time.

Another object of the present invention is to provide a decorative panel that is provided with a light source wherein the flatness of the decorative panel is secured.

The present invention thus relates a decorative panel, comprising a core layer provided with a decor layer, said décor layer comprising a substrate layer provided with at least one coating, characterized in that within said decorative panel at least one light source is located, said décor layer being transparent for light emitted by said at least one light source.

The present inventors found that with such a panel one or more of the aforementioned objects have been achieved. Especially the location of the at least one light source enables the provision of a panel from which the light source cannot be taken away without destructing the panel. In addition, according to the present invention the light source is seamlessly integrated into the panel during the manufacturing process of the panel. Therefore, no post-processing actions such as drilling of holes or openings need to be taken. Furthermore, the complete integration of the light source in the panel has resulted in a panel having a joint free surface. In addition, the original aesthetics of the panel provided with such a light source will be maintained. The same applies for the mechanical properties of the present panel provided with such a light source. The term "within the decorative panel" as used herein means that the at least one light source cannot been seen or touched from the outside of the decorative panel without destructing the decorative panel. This term means also that the at least one light source is not positioned at the outermost surface of the decorative panel, i.e. in a visible position, but in a position below the outermost surface of the decorative panel, i.e. in an invisible position. The term "said décor layer being transparent for light emitted by said at least one light source" covers also a décor layer that is semi-transparent. It is clear that the layer(s) between the light source and the outermost surface of the panel must show a certain transparency for the light emitted by the light source(s) present in the decorative panel. In the following description transparent covers also semi-transparent.

The at least one light source is preferably of the type Light Emitting Diodes (LEDs). Examples thereof can be identified as organic and inorganic LEDs, especially inorganic LEDs. Light emitting diodes (LEDs) are light sources that require low power consumption and can be qualified as in principle indestructible which make the LEDs as an interesting interactive element for integration into building materials. According to the present invention such a LED light source, with or without the electronic drivers, is seamlessly integrated into the decorative panel. The LED integrated in the present decorative panel is directed to emit the light towards the surface of the panel. The light emitted from the at least one light source will travel through one or more layer(s) of the decorative panel and therefore these layers must be transparent for the light rays emitted by the at least one light source. In a specific embodiment one or more of these layers may contain colour pigments. The present invention is not limited by the number of light sources, e.g. LEDs, incorporated in the decorative panel. LEDs in the form of a strip or supported on a substrate can be easily incorporated in the present decorative panel.

The LED can be made of inorganic or organic LED materials. The emitted light may be monochromatic, i.e. a specific wavelength, or may comprise a short range of wavelengths, or a mixture of several wavelength ranges, which will emit a defined type of colours or white light.

In a preferred embodiment of the decorative panel the at least one light source is cast into a protective matrix, wherein the protective matrix is transparent for light emitted by the at least one light source. The at least one light source, especially a LED, can be cast into a protective matrix, prior inclusion into panel. The protective matrix is transparent to the light that the light source(s) emit(s). Such a protective matrix protects the LED to temperature, pressure, and chemical reactions and reaction products during the process of making of the panel. Not only the light source but its electronic components, such as its electrical drivers, can be cast into a protective matrix as well. Please note that in some embodiments of the present decorative panel the at least one light source is not embedded in a protective matrix.

According to the present invention the at least one light source is located within the core layer.

It must be clear that the present invention is not restricted to only one specific position of the at least one light source in the present decorative panel. It is possible to have an embodiment wherein several light sources are located within the present decorative panel, even at different horizontal and vertical positions within the panel. This means also that light sources may be placed at the circumference the panel, at the centre, or in a specific geometric pattern, or any combination thereof. For example, in a specific embodiment of the present panel the light sources are positioned such that the decorative panel can be used for displaying computer generated graphics, videos, commercials etc.

The light source that is incorporated in the present panel can be deposited on a paper or another type of a carrier or support material, for example a flexible foil made of plastic or textile, or can consist of rigid or flexible support material. The at least one light source can be provided as a rigid light source or a flexible light source, or a combination thereof. The flexible light source is preferably chosen from the group consisting of a light source deposited on a flexible carrier, such as paper, plastic foil, metal, ceramic, glass or textile. In a specific embodiment of the present invention several light sources are present in a panel.

The light source(s) incorporated in the present panel require(s) at least one power supply. In a specific embodiment the light source is connected to an external power source, i.e. a power source that is not integrated in the panel as such. In such an embodiment the light source(s) can be connected to an external power source via separate wires. In another embodiment the panel also includes at least two light sources that are connected in series and/or parallel using wires. Such wires may be designed as a conductive mesh. The at least one wire or conductive mesh can be connected to an external power source for actuating the light source(s) located within the panel.

According to another embodiment a battery is used as a power source for the light source(s), wherein both the battery and the light source(s) are integrated in the present panel, i.e. within the present panel. In such an embodiment the power source can be identified as an internal power source. A battery can charge at least one integrated light source. Such a battery can be a wireless rechargeable battery. The use of a rechargeable battery enables to apply the present panel in areas where no power is available, such as in remote areas or in recreational areas, for example parking lots, campgrounds, beaches etc. The term battery as used here also encompasses a combination of individual batteries.

As discussed above, the mechanical properties of the decorative panel need to be maintained over a long time period. Any deterioration of the mechanical properties needs to be prevented. The present inventors found that the light source(s) in the present decorative panel may lead to a local increase of the temperature in the panel, especially when the light source is switched on or activated, i.e. the light source is emitting light. Such a local hot spot may have an adverse influence of the mechanical properties of the decorative panel, especially in the area surrounding the light source(s). In addition, the flat surface of the decorative panel is an important aspect of the panel. Thus, any irregularity in the surface, e.g. surface relief, of the panel should be prevented. And the incorporation of a light source in the decorative panel may need additional measurements for maintaining the flatness of the decorative panel. In addition, the inventors found that during the step of pressing the panel at elevated temperatures and pressures the resin present in the resin impregnated paper layers may lead to the formation of yellowish coloured cured compounds. These yellowish coloured cured compounds may have a negative influence on the power output of the light emitted by the light source(s). These yellowish coloured cured compounds will lower the intensity of the light emitted by the light source(s).

In an embodiment the decorative panel further comprises at least one intermediate layer, said at least one intermediate layer being positioned adjacent to said at least one light source.

In an embodiment the at least one intermediate layer is positioned between said at least one light source and said décor layer, said at least one intermediate layer being transparent for light emitted by said at least one light source. In such an embodiment the least one intermediate layer is positioned above the light source, as seen from the outermost surface of the panel, i.e. the side of the décor layer. In another embodiment the at least one intermediate layer is positioned below the light source, as seen from the outermost surface of the panel, i.e. the side of the décor layer.

In an embodiment the at least one intermediate layer comprises thermal conductive materials. These thermal conductive materials, for example metals, will function as heat dissipating means thereby preventing an unwanted increase of the temperature in the panel. In addition, the occurrence of heat will degrade the efficiency of the LED materials as well. An example of such an intermediate layer is a thermoplastic polymer matrix provided with metallic parts, or graphite. Another example of such intermediate layer is a resin impregnated paper provided with metallic parts, or graphite. The generation of heat will occur when the at least one light source is switched on, i.e. activated. Heat is generated by absorption of light from the LED and/or resistances in the electric circuitry. By transporting this heat away from the light emitting source, the degradation effects are suppressed. This can be obtained by placing a transparent or semi-transparent heat conductive film between the light source and décor, or directly below the light source. Such film can be, but is not limited to, a polyester composite film including compounds chosen from the group of graphene, graphite, iron micro-sized flakes, metal fibers, particles and flakes, or any combination thereof. Such films are for example manufactured by GNext, i.e. graphene polyester films (PET, PP, PLA; thickness 12 or 100 micrometer).

In another embodiment the at least one intermediate layer comprises a resin impregnated paper having an inhomogeneous resin distribution, wherein the resin concentration in said resin impregnated paper at an area corresponding to the position of said at least one light source is higher than another area of said resin impregnated paper. The resin content is between 20-300% of the paper weight, preferably between 20-70% in the low resin content regions and between 60-250% in the high resin content regions, preferable 100-250%.

This inhomogeneous resin distribution will have the effect that at the position of the at least one light source a higher amount of resin is present, resulting in a thicker and/or more dense cured network thereby strongly embedding the at least one light source in the core layer. In addition the higher concentration of resin at that specific position will penetrate into the surrounding areas thereby creating a stronger network after curing the resin. There are several methods known in this field of the art for applying curable resins to kraft or overlay papers. Besides the dip and squeeze method, where the paper is fully inserted into a resin bath followed by drying, other impregnation methods are also possible. For example, to apply a resin directly to the paper by rotary screen printing, roller coating, engraving, spray coating, curtain coating, flexographic printing, vacuum coating or ink jet coating and the like. It is also possible to use two or several methods simultaneously. Making use of an additive coating process that also applies the resin in a pattern, in transversal and/or longitudinal direction, the amount of resin can be altered locally on a scale of millimetres to meters, or preferably millimetres to centimetres.

The local excess of resin is patterned in the intermediate layer to correspond to the recesses in the core layer, for example the thermoformable sheet or prepreg, resin impregnated papers, as discussed above. The excess resin, which starts to flow during the heat-and-press cycle during production of the final decorative panel or laminate, is used to fill up the cavities around the light emitting device in the recess. In this way the relief is levelled out and the surface is flattened.

The layer adjacent to the light source, and below the décor is preferable kraft paper impregnated with a resin selected from the group consisting of phenol resin, melamine resin, urea resin, epoxy resin, polyester resin, polyisocyanate resin, melamine acrylate, polyurethane acrylate or combinations thereof, preferably phenolic, melamine or acrylate resins. Preferably, the paper has a weight of 15-200 g/m$^2$, in particular 70-100 g/m$^2$. In another embodiment, impregnation power and workability may be formed by overlay papers, nonwoven substrates, glass web or combinations thereof, in which connection especially overlay papers have a weight of 10-50 g/m$^2$, preferably 15-35 g/m$^2$.

In order to prevent a reduction in the output power of the light emitted by the at least one light source it is preferred that the at least one intermediate layer comprises a resin impregnated paper as discussed above.

The present inventors noted that phenolic resins may discolour to the yellow tint when subjected to heat and/or light in combinations with oxygen (as in e.g. the air). The cured phenolic resins will darken in color from the natural tint (whitish or yellowish) to dark yellow, brown and towards almost black. The color depends on the curing conditions. The colouring of the resins absorb part the output from the light emitting source which thus must operate at a higher efficiency to generate same output as if the resin was transparent. In addition, the present inventors noted that some type of resins that do not contain phenols are generally less sensitive to this kind of oxidation process. Such resins are for example melamine, polyisocyanate, epoxy or acrylate resins. A transparent resin is allowing the light emitted from the light source to be transported to the surface of the panel without significant absorption losses. A yellow coloured resin in the present intermediate layer is, however, absorbing part of the light from the source and this effect will thus result in a decreased effective light output from the panel. The present inventors found that melamine, polyisocyanate, epoxy or acrylate resins, and especially melamine and acrylic resins, are preferred types for incorporating in the present intermediate layer invention, where the light source is incorporated in the decorative panel. The application of these specific types of resins have resulted in the formation of less yellowish or brownish coloured resins, and these less yellowish or brownish coloured resins will less hinder the output power of the light emitted by the at least one light source, compared with cured resins on basis of phenol resins.

In the present decorative panel the core layer preferably comprises a thermo pressed stack of resin impregnated papers, for example phenol resin impregnated papers. According to another embodiment prepregs, non-wovens and wovens of wood fibres, glass fibres, textile fibres, synthetic fibres, metallic fibres, ceramic fibres, carbon fibres, or a mixture thereof, can be used to partly or completely replace the paper in the resin impregnated stack. In yet another embodiment the resin impregnated paper can be replaced by a prepreg. Such a prepreg can be considered as a consolidated core of a fibre containing material comprised of wood or cellulose fibres which are coated with a thermosetting synthetic resin. The thickness of prepregs may be considerable larger than a typical paper, and may include thicknesses >1 cm, or even greater.

A method for manufacturing prepregs has been disclosed in U.S. Pat. Nos. 4,503,115 and 6,387,489 in the name of the present applicant. For example according to U.S. Pat. No. 6,387,489 after drying the fibres are stored or passed directly to spreader equipment. The resin-treated fibres may be further processed without or with pigments. The mixture made from resin-treated fibres and pigments is introduced to spreader equipment which deposits the fibres and the pigments continuously and uniformly with random orientation, producing, distributed across the entire width of a horizontal conveyor belt, a web-like mat, which is press-molded either individually or together with other web-like mats of this type, to form the core layer. After continuous shaping of the mat on the conveyor belt, using scrapers, brushes, belts or rollers, the prepreg is given a preliminary press-moulding and compacted, with thickness reduction, in calendering equipment.

In another embodiment it is also possible to locate the at least one light source within the thermo pressed stack of resin impregnated papers.

In order to prevent the formation of an uneven outer surface of the present panel the present inventors found that is possible to provide the stack of resin impregnated papers with one or more recesses. Those recesses can be used to position the at least one light source in the respective recesses. In such an embodiment it is preferred that the recesses provided with light source(s) are covered with at least one thermo pressed resin impregnated paper. The formation of one or more recesses is valid for each type of core layer as mentioned above. The recesses can also be used for placement of the power source.

The present construction of the panel and the light source(s) is such that the light source(s) cannot be removed without destructing the panel. During the step of bonding together the individual components, i.e. the core layer, the light source(s) and the décor layer, with simultaneous application of heat, for example ≥120° C., and high specific pressure (>7 MPa) a homogeneous non-porous panel with increased density and integral decorative surface is obtained. The light source(s), optionally the power sources as well, are thus fully embedded in the present panel and these devices are invisible from the outside. Methods for manufacturing decorative panels have been disclosed in, inter alia, U.S. Pat. Nos. 4,801,495, 4,789,604, US Patent application 2013/0078437. The relevant parts disclosed in these publications regarding the process conditions for manufacturing these panels should be incorporated here by reference.

The present invention is also suitable for the production of CPL (continuous press laminates) and LPL (low pressure laminates). Low pressure laminates comprises materials used to coat surfaces, formed by two or three papers impregnated with melamine thermosetting resins to which plasticisers are added. The papers are joined strongly together by hot pressing at low pressures. The physical and technical properties of these materials are inferior to those of high pressure laminates, but are more than adequate for coating furniture components that will not undergo much stress and, in particular, are suitable for producing edges. A HPL (High Pressure Laminate) is manufactured via a high pressure/high temperature lamination process, while a CPL (Continuous Pressure Laminate) is laminated under low pressure. This results in variations in performance particularly in terms of strength and ease of installation. The present invention also covers the Double Belt Press (DBP) for the production of Continuous Pressed Laminate (CPL). CPL is decorative paper impregnated with resins and fused under heat and high pressure with resin impregnated backer(s). Laminate properties are similar to standard HPL and typical thickness range is 0.4 mm to 1 mm. Flexible CPL is decorative paper impregnated with flexible thermosetting resins and fused under heat and high pressure with resin-impregnated backer(s).

The present inventors found that instead of pressing the light source in-between the papers with thermo curable resins, at least one light source can be placed in cavities made in a thermo formable sheet of material. The dimensions of the cavity are preferably such that after placing the light source in the cavity of the sheet, the surface of the sheet will be completely flat. The sheet with light source(s) is placed within a stack of décor and papers with thermo curable resin, just below the décor, or with at least one paper with thermo curable resin between the sheet and the décor. In a specific embodiment the side of the sheet where the light source is placed is, is closest to the décor. According to another embodiment the décor is laminated onto the sheet with light source(s), the sheet acting as the core material. In yet another embodiment the thermo formable sheet replaces the substrate layer of the décor, or is incorporated above or below the substrate layer. In one of such embodiments the substrate layer of the décor layer comprises at least one thermo formable sheet. The adhesion can be stimulated by applying an adhesive on the sheet, the décor or both, before lamination.

In an embodiment the substrate layer of the décor layer is chosen from the group of resin impregnated papers, non-wovens and wovens made of wood fibres, glass fibres, textile fibres, synthetic fibres, metallic fibres, ceramic fibres and carbon fibres, or a combination of these fibres. In a specific embodiment resin impregnated papers can be combined with non-wovens and/or wovens. In another embodiment the substrate layer of the décor layer can also be chosen from the group of polymeric foils, metallic foils and ceramic foils, or a combination of anyone of these foils. In a specific embodiment resin impregnated papers can be combined with non-wovens and/or wovens and/or foils as mentioned here.

The thermo formable sheet may include one or more thermoplastic polymers, wherein the thermoplastic polymers will plastically deform upon applying thermal pressure. The thermoplastic sheet may include fillers, as minerals, reinforcement fibres of e.g. glass, synthetic, carbon, or other types. The purpose of the fillers is to modify the physical properties of the thermo formable sheet, as e.g. reinforce it.

The present invention also relates to a decorative panel wherein the core comprises at least one thermo formable sheet. In such an embodiment the core may further comprise a stack of resin impregnated papers, wherein the at least one thermo formable sheet is positioned between the décor layer and the stack of resin impregnated papers. In another embodiment a thermo curable layer is preferably positioned between the décor and the thermo formable sheet a thermo curable layer, preferably resin impregnated paper.

The at least one thermo formable sheet is preferably provided with one or more recesses, in which one or more recesses the at least one light source is placed. Such a recess may also contain a power source.

In a preferred embodiment the one or more recesses as mentioned before are provided with light reflecting means, such as aluminium foil layer. The light reflecting means are positioned such that the light rays emitted by the light source(s) are directed to the outer surface of the panel, i.e. the location where the light is visible as seen from the outside of the panel.

The integrated light source is encapsulated by the panel, which protects the integrated light source to the environment. Such environmental protection can include but is not limited to wind, weather, sun, chemicals, scratches, temperature, moisture and humidity. The encapsulation also prevents unintentional removal (theft) of the light source(s) and power source(s) when incorporated in the panel as well.

The present invention furthermore relates to the use of the present decorative panel in indoor and/or outdoor furniture. Examples of furniture are table tops, laboratory tables, kitchen work tops, nightstands, hot plates, countertops, benches, chairs, or stools, as well as tables, such as coffee tables, dining tables, cocktail tables, conference tables, side tables, picnic tables, or outdoor tables.

In a specific embodiment the present decorative panel can be used in exterior walls, ceilings and facades.

The present invention also relates to the use of the present decorative panel in interior and/or exterior decoration.

Examples of applications of the present panels include, but are not limited, to the following: domestic facade panels with incorporated sphere lightning that is invisible when not operating, interior kitchen horizontal panels with lighting that is only visible when switching on the light, table tops (horizontals) with invisible lights, dining table tops with incorporated sphere lighting, security lighting in panels inside airplanes, boats, busses, sphere lighting incorporated into panels for domestic use, only visible when lights are switched on, panels in airports, train stations, bus stations, ferry terminals or other public transportation means or at other public meeting places. The present panels can be used as exterior or interior panels in buildings or monuments as well. Another application is the integration of the present panel in the furniture or wall decoration at waiting stops or terminals for public and private transport, or the integration in the furniture or wall decoration in airplanes, cars, train wagons, bus interior or ferry interior. And, the use of the present panels in nightstands, bedside cabinets and worktops of a household kitchen.

The advantages of the present panel can thus be identified as follows: non-visible, seamless integration, flatness of outer surface, encapsulation, i.e. protection against environment, whereas the physical properties of panel remain unaltered compared to a panel without the present light source(s).

BRIEF DESCRIPTION OF THE DRAWINGS

Further advantages of the invention will become apparent by reference to the detailed description of preferred embodiments. Although the figures shown here only mention one light source the present invention is not restricted to a specific number of light sources. On basis of legibility and clarity all electrical (internal and external) connections and power sources have been omitted in the figures.

DETAILED DESCRIPTION

In the Figures the same reference numbers are used for the same components.

Figure 1:
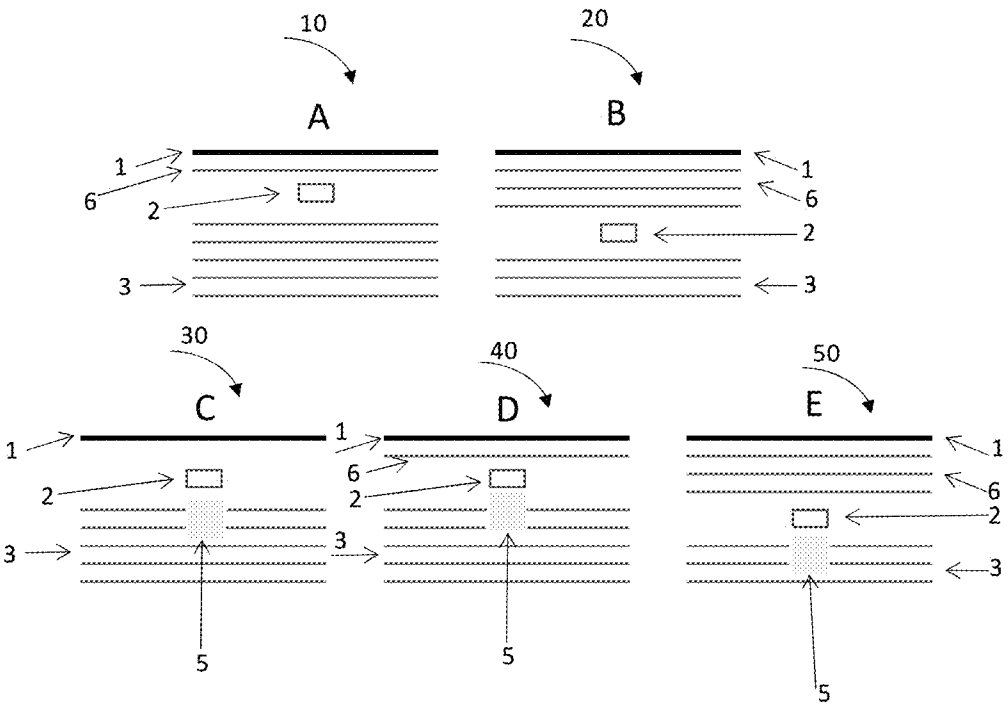
FIG. 1A shows a decorative panel according to the present invention.
FIG. 1B shows another embodiment of a decorative panel according to the present invention.
FIG. 1C shows another embodiment of a decorative panel according to the present invention.
FIG. 1D shows another embodiment of a decorative panel according to the present invention.
FIG. 1E shows another embodiment of a decorative panel according to the present invention.

FIG. 1A shows a panel 10 comprising a décor layer 1, an intermediate layer 6, a light source 2 and a core layer 3, wherein the light source 2 is positioned between core layer 3 and intermediate layer 6.

FIG. 1B shows a panel 20 comprising a décor layer 1, intermediate layer 6, a light source 2 and a core layer 3. Light source 2 is positioned in core layer 3. Intermediate layer 6 is positioned between core layer provided with light source 2 and décor layer 1.

FIG. 1C shows a panel 30 comprising a décor layer 1, a light source 2 and a core layer 3, wherein the light source 2 is positioned in recess 5 provided in core layer 3. The presence of such a recess will help to prevent the occurrence of relief at the outer surface thereof, i.e. at the décor layer.

FIG. 1D shows a panel 40 comprising a décor layer 1, an intermediate layer 6, a light source 2 and a core layer 3, wherein the light source 2 is positioned in recess 5 provided in core layer 3. The intermediate layer 6 is positioned between décor layer 1 and light source 2. The presence of such a recess will help to prevent the occurrence of relief at the outer surface thereof, i.e. at the décor layer. And the presence of the intermediate layer 6 will further help to prevent the occurrence of relief at the outer surface thereof, i.e. at the décor layer.

FIG. 1E shows a panel 50 comprising a décor layer 1, intermediate layer 6, a light source 2 and a core layer 3. Light source 2 is positioned in recess 5 provided in core layer 3. Intermediate layer 6 is positioned between décor layer 1 and light source 2. The presence of such a recess will help to prevent the occurrence of relief at the outer surface thereof, i.e. at the décor layer. And the presence of the intermediate layer 6 will further help to prevent the occurrence of relief at the outer surface thereof, i.e. at the décor layer.

In the embodiments shown here the resin concentration of the intermediate layer(s) at an area corresponding to the position of the light source may be higher than another area of the intermediate layer(s). In the embodiments shown here the resin composition of the intermediate layer(s) may be chemically different from the resin composition of the core layer. In the embodiments shown here the intermediate layer(s) may comprise heat conductivity enhancing materials. The presence of intermediate layer will help to prevent the occurrence of relief at the outer surface thereof, i.e. at the décor layer. In addition, the presence of intermediate layer will have a positive influence on the mechanical properties of the final decorative panel. Although intermediate layer is depicted here as a single layer, such an intermediate layer may comprise one or more sub layers. In addition, core layer is depicted here as a number of layers, but core layer may comprise one single layer, for example a prepreg, or a combination of layers, for example several prepregs, or individual layers and one or more prepregs.

Figure 2:
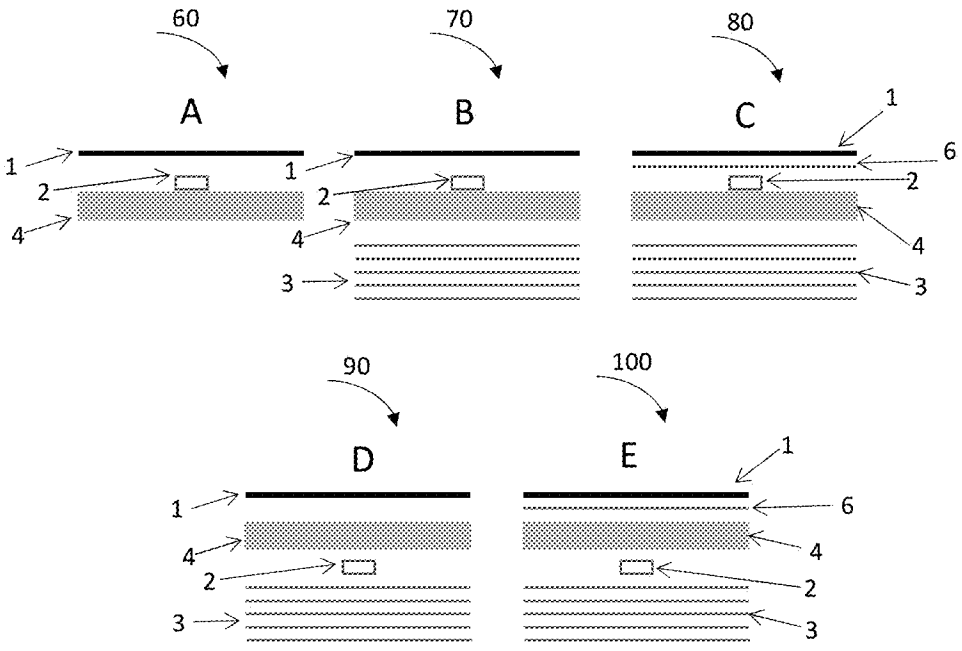
FIG. 2A shows a decorative panel according to the present invention.
FIG. 2B shows a decorative panel according to the present invention.
FIG. 2C shows a decorative panel according to the present invention.
FIG. 2D shows another embodiment of a decorative panel according to the present invention.
FIG. 2E shows another embodiment of a decorative panel according to the present invention.
FIG. 2F shows another embodiment of a decorative panel according to the present invention.
FIG. 2G shows another embodiment of a decorative panel according to the present invention.
FIG. 2H shows another embodiment of a decorative panel according to the present invention.
FIG. 2I shows another embodiment of a decorative panel according to the present invention.
FIG. 2J shows another embodiment of a decorative panel according to the present invention.
FIG. 2K shows another embodiment of a decorative panel according to the present invention.
Figure 2:
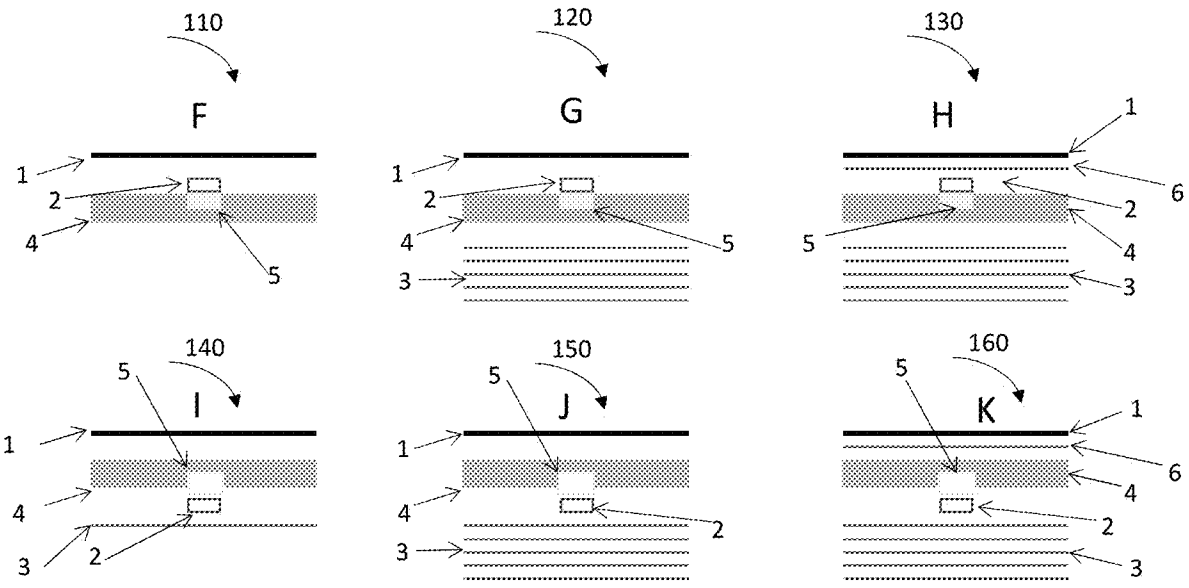
Figure 3:
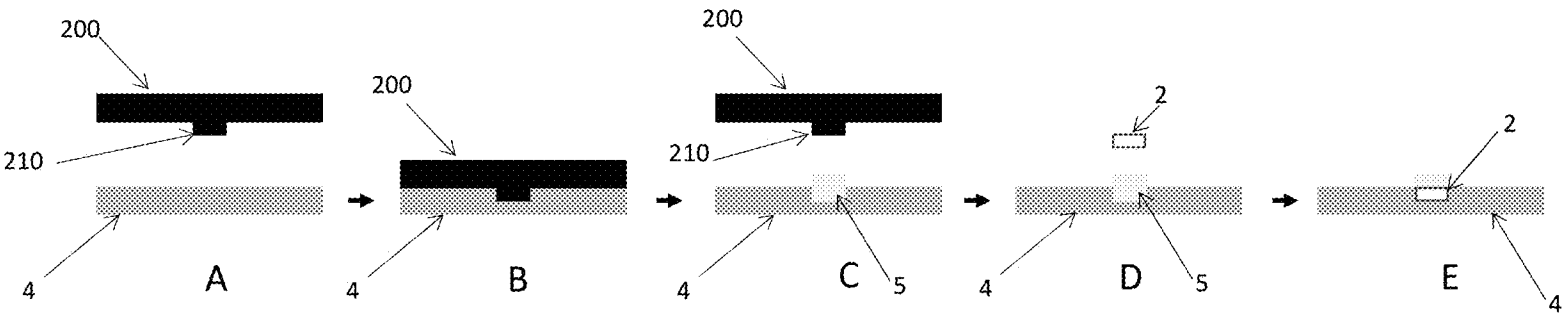
FIGS. 3A-3E show different stages of a thermoforming process according to the present invention.

FIG. 2A shows a panel 60 comprising a décor layer 1, a light source 2 and a core layer, comprising a thermoformable sheet or prepreg 4. Light source 2 is positioned between the core layer and décor layer. During the pressing step for manufacturing the panel the light source 2 will be somewhat pressed into the thermoformable sheet or prepreg 4. The panel thus obtained may experience some relief at the outer surface thereof, i.e. at the décor layer.

FIG. 2B shows a panel 70 comprising a décor layer 1, a light source 2 and a core layer, comprising a thermoformable sheet or prepreg 4 and a number of resin impregnated paper layers 3. Light source 2 is positioned between the core layer and décor layer. A disadvantage of such a construction is the lack of flatness of the panel. During the pressing step for manufacturing the panel the light source 2 will be somewhat pressed into the thermoformable sheet or prepreg 4. The panel thus obtained may experience some relief at the outer surface thereof, i.e. at the décor layer.

FIG. 2C shows a panel 80 comprising a décor layer 1, a light source 2, an intermediate layer 6 and a core layer 3, comprising a thermoformable sheet or prepreg 4 and a number of resin impregnated paper layers 3. The intermediate layer 6 is positioned between core layer and décor layer. During the pressing step for manufacturing the panel the light source 2 will be somewhat pressed into the thermoformable sheet or prepreg 4. The presence of the intermediate layer 6 will help to prevent the occurrence of relief at the outer surface thereof, i.e. at the décor layer.

FIG. 2D shows a panel 90 comprising a décor layer 1, a light source 2 and a core layer, comprising of a thermoformable sheet 4 or prepreg 4 and a number of resin impregnated paper layers 3. Light source 2 is positioned in the core layer, namely between thermoformable sheet or prepreg 4 and a number of resin impregnated paper layers 3. During the pressing step for manufacturing the panel the light source 2 will be somewhat pressed into the thermoformable sheet or prepreg 4.

FIG. 2E shows a panel 100 comprising a décor layer 1, a light source 2, an intermediate layer 6 and a core layer, comprising of a thermoformable sheet 4 or prepreg 4 and a number of resin impregnated paper layers 3. Light source 2 is positioned in the core layer, namely between thermoformable sheet or prepreg 4 and a number of resin impregnated paper layers 3. During the pressing step for manufacturing the panel the light source 2 will be somewhat pressed into the thermoformable sheet or prepreg 4. The presence of the intermediate layer 6 will help to prevent the occurrence of relief at the outer surface thereof, i.e. at the décor layer.

FIG. 2F shows a panel 110 comprising a décor layer 1, a core layer comprising a thermoformable sheet 4 or prepreg 4 provided with a recess 5. In recess 5 a light source 2 is positioned. The presence of such a recess will help to prevent the occurrence of relief at the outer surface thereof, i.e. at the décor layer.

FIG. 2G shows a panel 120 comprising a décor layer 1, a core layer comprising a thermoformable sheet 4 or prepreg 4 provided with a recess 5. In recess 5 a light source 2 is positioned. Panel 120 is further provided with a number of resin impregnated papers 3. The presence of such a recess will help to prevent the occurrence of relief at the outer surface thereof, i.e. at the décor layer.

FIG. 2H shows a panel 130 comprising a décor layer 1, an intermediate layer 6, a core layer comprising a thermoformable sheet 4 or prepreg 4 and a number of resin impregnated papers 3. Thermoformable sheet 4 or prepreg 4 is provided with a recess 5, in which recess 5 a light source 2 is positioned. Recess 5 is located at the upper surface of thermoformable sheet 4 or prepreg 4. The presence of the intermediate layer 6 will help to prevent the occurrence of relief at the outer surface thereof, i.e. at the décor layer.

FIG. 2I shows a panel 140 comprising a décor layer 1, a core layer comprising a thermoformable sheet 4 or prepreg 4 and resin impregnated paper 3. Thermoformable sheet 4 or prepreg 4 is provided with a recess 5 at its bottom surface, in which recess 5 a light source 2 is positioned.

FIG. 2J shows a panel 150 comprising a décor layer 1, a core layer comprising a thermoformable sheet 4 or prepreg 4 and resin impregnated paper 3 provided with a recess 5. Thermoformable sheet 4 or prepreg 4 is provided with a recess 5 at its bottom surface, in which recess 5 a light source 2 is positioned.

FIG. 2K shows a panel 160 comprising a décor layer 1, an intermediate layer 6, a core layer comprising a thermoformable sheet 4 or prepreg 4 and a number of resin impregnated papers 3. Thermoformable sheet 4 or prepreg 4 is provided with a recess 5, in which recess 5 a light source 2 is positioned. Recess 5 is located at the bottom surface of thermoformable sheet 4 or prepreg 4. The presence of the intermediate layer 6 will help to prevent the occurrence of relief at the outer surface thereof, i.e. at the décor layer.

In the embodiments shown the resin concentration of the intermediate layer(s) at an area corresponding to the position of the light source may be higher than another area of the intermediate layer(s). In the embodiments shown the resin composition of the intermediate layer(s) may be chemically different from the resin composition of the core layer. In the embodiments shown the intermediate layer(s) may comprise heat conductivity enhancing materials. The presence of intermediate layer will help to prevent the occurrence of relief at the outer surface thereof, i.e. at the décor layer. In addition, the presence of intermediate layer will have a positive influence on the mechanical properties of the final decorative panel.

FIGS. 3A-E show different stages of a thermoforming process according to the present invention, wherein in step 3A a hot press 200 with structure 210 is brought into contact with a thermoformable sheet 4 or prepreg 4. In step 3B the structure 210 creates a thermo deformation in thermoformable sheet 4 or prepreg 4. In step 3C the contact between hot press 200 and thermoformable sheet 4 or prepreg 4 is interrupted resulting in the formation of a recess 5 in thermoformable sheet 4 or prepreg 4. In step 3D a light source 2 is positioned in recess 5, resulting in a thermoformable sheet 4 or prepreg 4 provided with a light source 2.

Example 1

A prepreg manufactured according to U.S. Pat. No. 6,387,489 was provided with a recess. A LED strip was placed in the recess and a décor layer was positioned on top of the recess as the outer surface. The composite thus obtained was pressed at 160° C. and 20 bars until curing of the thermoset resin was achieved. The LED strip was connected with a cable to a transformer. The LED lights functioned well and its colour was changed on demand.

Example 2

A prepreg manufactured according to U.S. Pat. No. 6,387,489 was provided with a recess. A LED strip was placed in the recess and a décor layer was positioned on top of the recess as the outer surface. The composite thus obtained was pressed at 130° C. and 20 bars until curing of the thermoset resin was achieved. The LED strip was connected with a cable to a transformer. The monochromic LED lights functioned well and emitted light on demand.

Example 3

A prepreg manufactured according to U.S. Pat. No. 6,387,489 was provided with a recess. A LED strip was placed in the recess and a décor layer was positioned on top of the recess as the outer surface. The composite thus obtained was pressed at 160° C. and 70 bars until curing of the thermoset resin was achieved. The LED strip was connected with a cable to a transformer. The monochromic LED lights functioned well and emitted light on demand.

Example 4

A prepreg manufactured according to U.S. Pat. No. 6,387,489 was provided with a recess. A LED strip was placed in the recess and a décor layer was positioned on top of the recess as the outer surface. The composite thus obtained was pressed at 130° C. and 70 bars until curing of the thermoset resin was achieved. The LED strip was connected with a cable to a transformer. The monochromic LED lights functioned well and emitted light on demand.

Example 5

A stack of resin impregnated papers was provided and the outer most layers were cut such that a recess was obtained. A LED strip was placed in the recess of resin impregnated papers, and a décor layer was positioned on top of the recess as the outer surface. The composite thus obtained was pressed at 160° C. and 20 bars until curing of the thermoset resin was achieved. The LED strip was connected with a cable to a transformer. The LED lights functioned well and its colour was changed on demand.

Example 6

A stack of resin impregnated papers was provided and the outer most layers were cut such that a recess was obtained. A LED strip was placed in the recess of resin impregnated papers, and a décor layer was positioned on top of the recess as the outer surface. The composite thus obtained was pressed at 160° C. and 70 bars until curing of the thermoset resin was achieved. The LED strip was connected with a cable to a transformer. The LED lights functioned well and its colour was changed on demand.

Example 7

A stack of resin impregnated papers was provided and the outer most layers were cut such that a recess was obtained. A LED strip was placed in the recess of resin impregnated papers, and a décor layer was positioned on top of the recess as the outer surface. The composite thus obtained was pressed at 130° C. and 20 bars until curing of the thermoset resin was achieved. The LED strip was connected with a cable to a transformer. The LED lights functioned well and its colour was changed on demand.

Example 8

A stack of resin impregnated papers was provided and the outer most layers were cut such that a recess was obtained. A LED strip was placed in the recess of resin impregnated papers, and a décor layer was positioned on top of the recess as the outer surface. The composite thus obtained was pressed at 130° C. and 70 bars until curing of the thermoset resin was achieved. The LED strip was connected with a cable to a transformer. The LED lights functioned well and its colour was changed on demand.

Example 9

A prepreg manufactured according to U.S. Pat. No. 6,387,489 was provided with a recess. A LED strip was placed in the recess and a thermo formable sheet was positioned directly on top of the recess. The thermo formable sheet thus positioned was covered with a décor layer as the outer surface. The composite thus obtained was pressed at 160° C. and 20 bars until curing of the thermoset resin was achieved. The LED strip was connected with a cable to a transformer. The LED lights functioned well and its colour was changed on demand. The specific position of the thermo formable sheet equalized the surface, and acted as light guide for the LED light. The light from the LED shines through the décor and is transported to the side edges of the panel. The effect is a decorative panel with glowing edges.

The invention claimed is:

1. A decorative panel, comprising a core layer provided with a decor layer, said décor layer comprising a substrate layer provided with at least one coating, wherein within said decorative panel at least one light source is located, said décor layer being transparent to light emitted by said at least one light source;

wherein said decorative panel further comprises at least one intermediate layer positioned adjacent to said at least one light source; and wherein said at least one intermediate layer comprises a resin impregnated paper having an inhomogeneous resin distribution, wherein a resin concentration in said resin impregnated paper at an area corresponding to the position of said at least one light source is higher than another area of said resin impregnated paper.

2. The decorative panel according to claim 1, wherein said at least one light source is a Light Emitting Diode (LED) chosen from the group of organic and inorganic LEDs.

3. The decorative panel according to claim 1, wherein said at least one light source is located within the core layer.

4. The decorative panel according to claim 1, wherein said at least one light source is cast into a protective matrix, said protective matrix being transparent to light emitted by said at least one light source.

5. The decorative panel according to claim 1, wherein said decorative panel further comprises at least one power source connected to said at least one light source.

6. The decorative panel according to claim 1, wherein said decorative panel comprises at least two light sources, said at least two light sources being connected in series or in parallel by wires connectable to at least one power source.

7. The decorative panel according to claim 6, wherein said at least one power source is not incorporated in said decorative panel.

8. The decorative panel according to claim 1, wherein said at least one intermediate layer is positioned between said at least one light source and said décor layer, said at least one intermediate layer being transparent to light emitted by said at least one light source.

9. The decorative panel according to claim 1, wherein said at least one intermediate layer comprises thermally conductive materials.

10. The decorative panel according to claim 1, wherein said at least one intermediate layer comprises a resin impregnated kraft paper, wherein the resin is selected from the group consisting of phenol resin, melamine resin, urea resin, epoxy resin, polyester resin, polyisocyanate resin, melamine acrylate, polyurethane acrylate and combinations thereof.

11. The decorative panel according to claim 1, wherein said core layer is chosen from the group of resin impregnated papers, prepregs, non-wovens and wovens of wood fibres, glass fibres, textile fibres, synthetic fibres, metallic fibres, ceramic fibres and carbon fibres, or a mixture thereof, wherein said core layer comprises a thermo pressed stack of resin impregnated papers.

12. The decorative panel according to claim 11, wherein said at least one light source is located in said thermo pressed stack of resin impregnated papers.

13. The decorative panel according to claim 11, wherein said stack of resin impregnated papers is provided with one or more recesses in which said at least one light source is disposed.

14. The decorative panel according to claim 13, wherein said one or more recesses provided with said at least one light source are covered with at least one thermo pressed resin impregnated paper transparent to light emitted by said at least one light source.

15. The decorative panel according to claim 13, wherein said one or more recesses are provided with light reflecting means.

16. The decorative panel according to claim 1, wherein said core comprises at least one thermo formable sheet.

17. The decorative panel according to claim 16, wherein said core further comprises a stack of resin impregnated papers, wherein said at least one thermo formable sheet is positioned between said décor layer and said stack of resin impregnated papers.

18. The decorative panel according to claim 17, wherein a thermo curable layer of resin impregnated paper is positioned between said décor layer and said thermo formable sheet.

19. The decorative panel according to claim 16, wherein said at least one thermo formable sheet is provided with one or more recesses in which said at least one light source is placed.

20. The decorative panel according to claim 1, wherein said core layer further comprises at least one prepreg.

21. The decorative panel according to claim 20, wherein said at least one prepreg is provided with one or more recesses in which said at least one light source is placed.

22. The decorative panel according to claim 1, wherein said substrate layer of said décor layer is chosen from the group of resin impregnated papers, non-wovens and wovens of any one or more of wood fibres, glass fibres, textile fibres, synthetic fibres, metallic fibres, ceramic fibres and carbon fibres, foils of any one or more of polymers, metals and ceramics, or a combination of anyone of these, wherein the structure of said substrate layer is such that said décor layer including said substrate layer is transparent to light emitted by said at least one light source.

23. The decorative panel according to claim 1, wherein said at least one light source is provided as a rigid light source or a flexible light source, or a combination thereof, said flexible light source chosen from the group consisting of a light source deposited on a flexible carrier made of paper, plastic foil, metal, ceramic, glass or textile.

24. The decorative panel according to claim 1, wherein said at least one light source cannot be removed without destructing said decorative panel.

25. The decorative panel according to claim 1, wherein said at least one light source is invisible as viewed from outside of the décor layer.

26. The decorative panel according to claim 1 used in at least one of indoor furniture, outdoor furniture, table tops, laboratory tables, kitchen countertops, dining tables, nightstands, picnic tables, hot plates, countertops, indoor decorations, outdoor decorations, interior walls, exterior walls, ceilings, and facades.

27. A decorative panel, comprising:

a core layer provided with a décor layer, said décor layer comprising a substrate layer provided with at least one coating, wherein within said decorative panel at least one light source is located, said décor layer being transparent to light emitted by said at least one light source;

wherein said core layer comprises a thermo pressed stack of resin impregnated papers; and wherein said at least one light source is located in said thermo pressed stack of resin impregnated papers.

28. A decorative panel, comprising a core layer provided with a décor layer, said décor layer comprising a substrate layer provided with at least one coating, wherein within said decorative panel at least one light source is located, said décor layer being transparent to light emitted by said at least one light source;

wherein said core layer comprises a thermo pressed stack of resin impregnated papers; and wherein said thermo pressed stack of resin impregnated papers is provided with one or more recesses in which said at least one light source is disposed.

* * * * *